United States Patent [19]

Hoefler

[11] Patent Number: 5,020,185

[45] Date of Patent: Jun. 4, 1991

[54] DISPOSABLE DUST PAN AND METHOD

[76] Inventor: Raphael A. Hoefler, 8181 19th St., Westminster, Calif. 92683

[21] Appl. No.: 312,961

[22] Filed: Feb. 21, 1989

[51] Int. Cl.[5] ..... A47L 25/00

[52] U.S. Cl. ..... 15/257.1; 206/447; 206/634; 229/1.5 B; 229/4.5; 294/1.3; 294/55

[58] Field of Search ..... 15/257.1, 257.4, 257.9, 15/104.8; 294/1.3, 55; 383/4, 93; 229/1.5 B, 4.5, 1.5 R; 206/554, 223, 447, 634

[56] References Cited

U.S. PATENT DOCUMENTS

| | | | |
|---|---|---|---|
| 1,007,918 | 12/1911 | Chambers | 229/1.5 B |
| 2,144,456 | 1/1939 | Heywood | 229/1.5 B |
| 2,200,111 | 5/1940 | Bensel | 229/1.5 B |
| 3,345,670 | 10/1967 | Charie | 15/257.1 |
| 3,676,887 | 7/1972 | Klein | 15/257.9 |
| 3,765,044 | 10/1973 | Hanahan | 15/104.8 |
| 3,995,807 | 12/1976 | Dell'Anno | 15/257.1 |
| 4,155,581 | 5/1979 | Kanaga | 294/1.3 |
| 4,686,734 | 8/1987 | Kahan | 15/257.1 |

FOREIGN PATENT DOCUMENTS

| | | | |
|---|---|---|---|
| 1516205 | 1/1968 | France | 206/447 |
| 946533 | 1/1964 | United Kingdom | 294/1.3 |

*Primary Examiner*—Harvey C. Hornsby
*Assistant Examiner*—Mark Spisich

[57] ABSTRACT

The invention is a disposable dust pan. It is stored as a flat sheet in a stack ready for use. When needed, one sheet is peeled away from the stack and folded to form a convenient dust pan. Non-hardening adhesive is used to hold the sheet in the folded orientation and to seal one edge to the surface requiring cleaning. After use, the dust pan is sealed to trap dust and debris within a folded pocket and then the entire device is discarded.

4 Claims, 2 Drawing Sheets

DISPOSABLE DUST PAN AND METHOD

BACKGROUND OF THE INVENTION

The invention relates to devices useful for pickup and removal of dust and other debris and more specifically to dust pans especially of the one-use disposable type.

DESCRIPTION OF THE PRIOR ART

The concept of a disposable dust pan is appealing since it simplifies the act of disposing of dust and debris. A non-disposable dust receptacle requires maintenance and periodic cleaning to prevent the inadvertent spreading of dust during the storage and transporting of the device. Additionally, disposal of dust is a problem since transfer of dust from a conventional non-disposable dust pan to a dust receptacle such as a bag or other container generates a dust cloud and often results in spillage. The disposable dust pan solves these problems and is therefore inherently a cleaner system.

The conventional dust pan consists of a metal or plastic flat tray with low walls on three sides and a thin edge on the forth side. In use with thin edge is placed against a flat surface containing dust or debris a broom or brush is used to sweep the dust or debris onto the flat tray surface over the thin edge. A handle is usually attached to this type of dust pan in order to permit ease of manipulation. Dust picked up onto the dust pan is then transferred to a receptacle and the dust pan is then stored for future use.

The prior art contains three patents for dust pan devices which are of interest with respect to the instant invention. U.S. Pat. No. 3,345,670 to Charle teaches a one piece paperboard panel foldable into a collapsible, disposable dust pan having a handle member integral with the rear wall thereof. U.S. Pat. No. 3,765,044 to Hanahan et al. teaches a folding carton of self supporting sheet material, the minor portion being removable on a tear line to form the major portion as an open-topped, rectangular litter bag or dust pan. U.S. Pat. No. 4,686,734 to Kahan teaches a dust pan form and design including a flexible material forming the interface edge over which debris is sweeped.

None of the prior art disclosures show the combination of features and capabilities of the instant invention. It is the applicant's opinion that the instant invention is not shown nor predicted by the prior art and that it is an effective device for the intended use providing certain advantages especially in the areas of cost, cleanliness and ease of use.

SUMMARY OF THE INVENTION AND OBJECTS

The invention is a disposable debris collection device intended for use with any brush, broom or other means for sweeping debris from any flat or near flat surface onto the invention. The device comprises a rectangular flexible sheet with a non-drying adhesive layer affixed to the top side as a narrow border along three edges and a second non-drying adhesive layer affixed to the bottom side of the sheet as a narrow border along the forth edge. The sheet may be made of waterproof material such as paper with a wax coated surface.

The device can be conveniently handled in a stack where similar edges are aligned and arranged with each sheet in contact with and adhered to the next, thus forming a book-like structure whereby one sheet at a time is easily peeled away and used independently of the remaining stack. Each sheet is used by folding the central of the three common edges having an adhesive border, in half and pressing both halves together to seal that one edge. The device is held with one hand by the sealed edge and placed upon a surface requiring cleanup while rotating the sealed edge toward the open end until the majority of the open end edge is in contact with the flat surface. The adhesive on the bottom surface along the open end edge is then pressed against the flat surface to assure good and continuous attachment along the entire edge and then debris is swept onto the device. The non-drying adhesive permits repeated effective edge contact permitting the shifting of the invention a number of times during its use. After all dust is swept onto the device, dust is forced into the closed end formed by the sealed edge by tilting the device upward, and tapping it. After all dust is within the invention device it is placed against the flat surface again and the closed end is sealed by pressing downward upon the top of the device until the top surface is sealed against the bottom surface. The device is then discarded with all dust and debris tightly sealed within it.

It is one object of the instant invention to provide a new and unique device and method of using said device which is designed to overcome the drawbacks of reusable dust pans including the need to clean them and the problem of spreading dust from one location to another when moving the dust pan from oen cleaning job to the next and when transferring dust from the dust pan to a permanent receptacle.

Another object and prominent feature of the within invention is to provide a dust pan which has the convenience of flat storage being conveniently stored as a stack whereby each sheet remains ready to be peeled off and used.

An alternate object and prominent feature of the within invention is to provide a dust pan which forms a tight seal with the surface it is placed upon especially rough or non-flat surfaces in order to more effectively pick up minute dust particles.

A further object of the invention is to provide a dust pan which contains a pocket into which dust can be sealed for disposal.

A still further object of the invention is to provide a dust pan which is extremely inexpensive to manufacture.

A yet still further object of the invention is to provide a disposable dust pan which can accommodate small amounts of liquid or wet debris.

These, together with the various ancillary objects and features of the invention which will become apparent as the following description proceeds, are attained by this unique disposable dust pan and method of using same, the preferred embodiment thereof being shown in the accompanying drawings, by way of example only.

DETAILED DESCRIPTION OF THE PREFERRED EMBODIMENT

Figure 2:
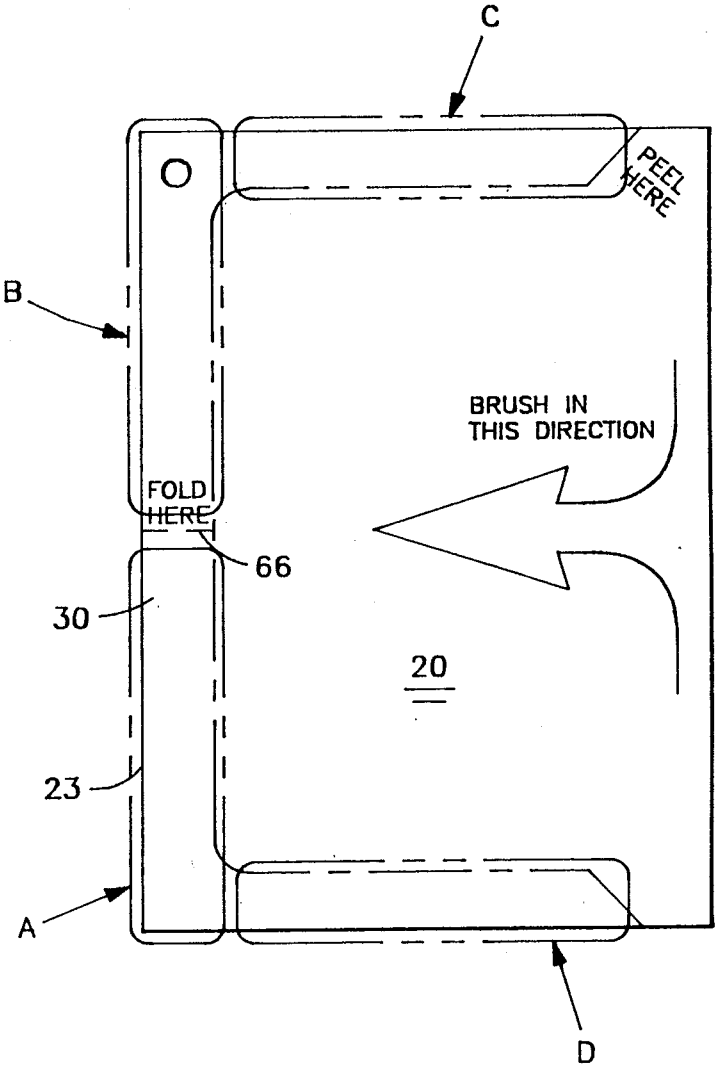
FIG. 2 is a plan view of the invention before being formed.
Figure 1:
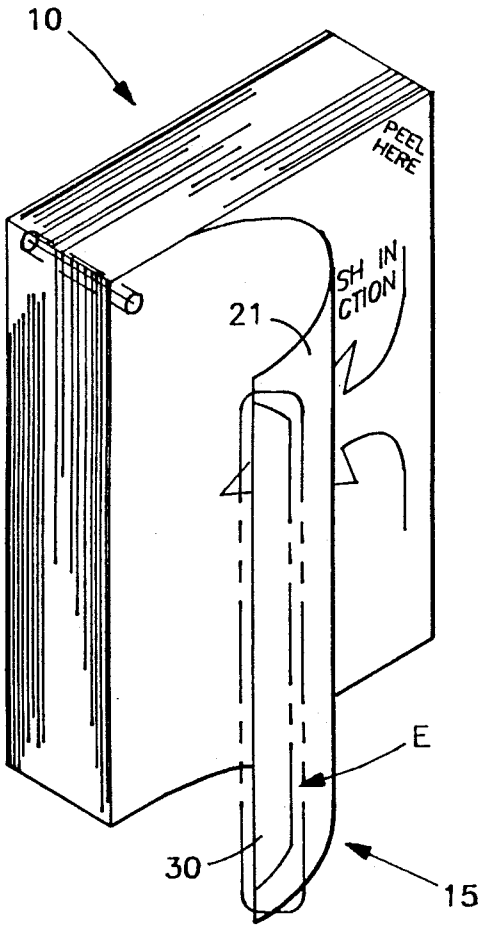
FIG. 1 is a perspective drawing of the invention mounted in a stack showing the method of removing one sheet.

As shown in FIGS. 1 and 2, flexible sheet 15 has first side 20 and second side 21 coated with adhesive 30 in areas A, B, C, D and E. Adhesive 30 has a low sticking coefficient so that areas A, B, C, D and E, can be adheared to other surfaces and then subsequently removed easily and without leaving residue or damaging sheet 15. Sheet 15 is preferably made of paper or other thin flexible material and can be made of a water repelling material or treated with a water repellant. Various use instructions including instructions for folding sheet 15 into a collection device can be printed upon first side 20 and second side 21 such as those shown in FIG. 2; "PEEL HERE", "BRUSH IN THIS DIRECTION", "FOLD HERE", etc. As shown in FIG. 1 a plurality of sheets 15 can be formed into stack 10 for convenient storage and dispensing of each sheet 15 as needed. Adhesive 30 holds sheets 15 together in stack 10. Each sheet 15 can thereafter be individually peeled away from stack 10 for use.

Figure 4:
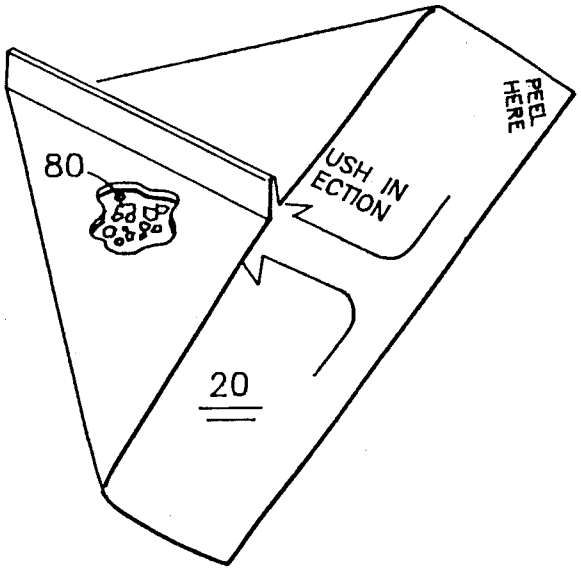
FIG. 4 is a perspective drawing of the invention showing the method of sealing in preparation for disposal.
Figure 3:
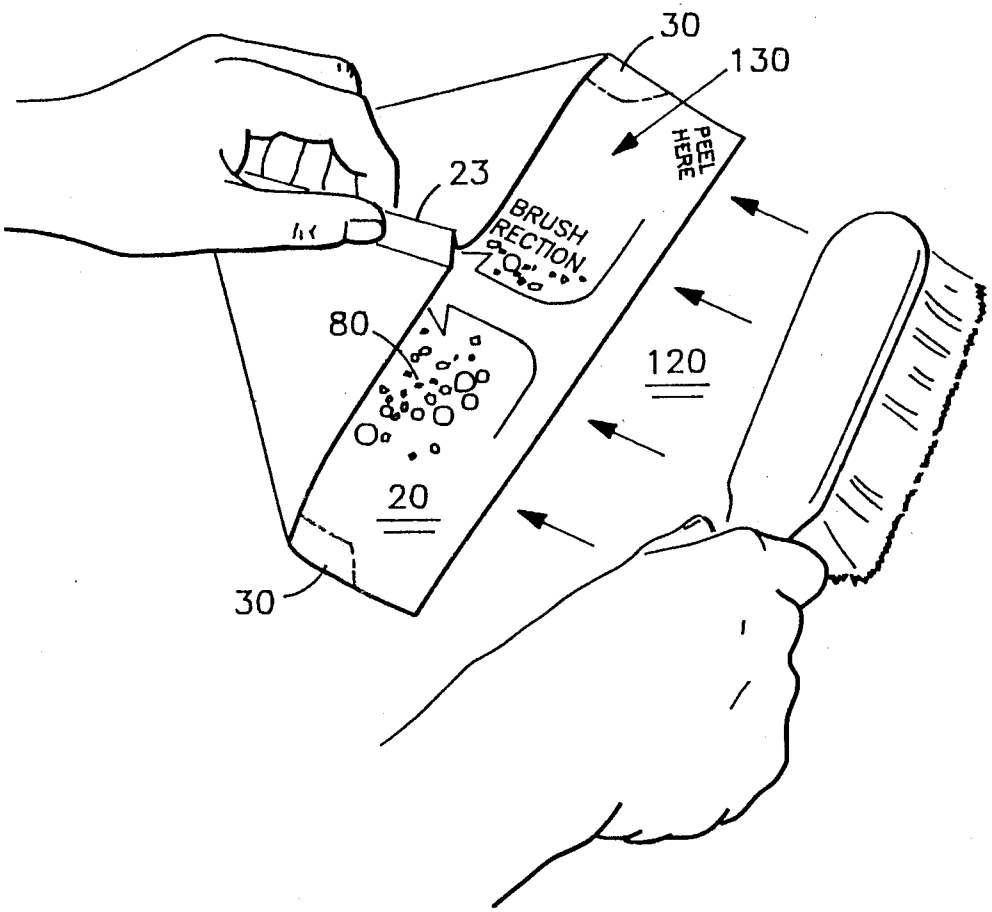
FIG. 3 is a perspective drawing of the invention after forming and showing the method of use.

Sheet 15 is formed into a device for collecting loose material 80, usually referred to as a dust pan, as shown in FIG. 3, by folding sheet 15 at fold line 66 to join areas A and B to each other, then bringing edge 23 into a position above and parallel to first side 20, to form pocket 130. In this folded shape, sheet 15 is used for collecting loose material 80 such as dust and debris or other materials including liquids or wet substances, by pressing area E against a surface 120 thereby forming a tight seal of second side 21 to surface 120, then brushing loose material 80 from surface 120 onto first side 20 and therefrom into pocket 130. As shown in FIG. 4, adhesive 30 in areas C and D is pressed against first side 20 in order to seal loose material 80 within pocket 130.

Having thus described my invention what I claim as new, useful and non-obvious and, accordingly secure by Letters Patent of the United States is:

1. A disposable collecting device comprising a flat and flexible rectangular sheet having opposed faces and four side edges on each face and intersecting corners, the first side edge opposite the second side edge and the third side edge opposite the fourth side edge; and adhesive coating placed along substantially the entire length of said first side edge on one face of said sheet and an adhesive coating placed along the entire length of said second edge and along substantially the entire length of said third and fourth side edges on the opposite face of said sheet; said collecting device being formed by folding said sheet to form a pocket, said pocket being formed by folding both the corners between the second and third side edges and the second and fourth side edges toward a center of the sheet about a fold line located about midway along the second side edge which divides said second side edge into two adhesive sections and said two adhesive sections of said second side edge being folded into mutual adhesive contact to form said pocket; said pocket functions as a receptacle for dirt particles and the like which may be swept into said pocket with the aid of a brush or broom, said first side edge, by virtue of its adhesive coating, being pressed against the surface to be cleaned in order to secure the pan in place while in use, said third and fourth side edges being pressed down into engagement with the top of the first side edge to form an enclosure, thus trapping said particles for convenient disposal.

2. The disposable collecting device of claim 1 wherein the sheet is made of a water repelling material.

3. The disposable collecting device of claim 1 wherein a plurality of said sheets can be formed into a stack by adhering the adhesive coating of one sheet on the opposite face of a subjacent sheet, thus forming the stack from which one sheet at a time may be removed as needed by peeling one sheet from the remaining stack.

4. A method of pre-preparation, on-site assembly, use and convenient disposal of disposable collection means for dust, dirt particles, debris and the like, comprising the steps of preparation of a flat and flexible rectangular disposable sheet having opposed faces and four side edges on each face and intersecting corners, the first side edge opposite the second side edge and the third side edge opposite the fourth side edge, by placing an adhesive coating along substantially the entire length of said first side edge on one face of said sheet and additional adhesive coatings along substantially the entire length of said second edge and along substantially the entire length of said third and fourth side edges on the opposite face of said sheet, thus completing said preparation;

selecting a flat surface as a site for collection of dust and debris;

folding said sheet in half on said opposite face at said second edge while mutually aligning the halves until one half of said adhesively coated second edge contacts and adheres to the second half of said adhesively coated second edge at a joined edge, thereby forming a pocket with one closed end for retention of dirt particles, while assuring that said third and fourth edges are in contact only to the extent of the width of said adhesive coating along said second edge;

holding said sheet with one hand at said joined edge and, with said third and fourth edges of said opposite face facing opposite said flat surface pressing said sheet against said flat surface, while rotating said joined edge toward said first edge until the majority of said first edge is in contact with said flat surface;

pressing said first edge against said flat surface to assure good adhesion between said adhesive coating placed on said one face of said sheet and said flat surface, thereby adhesively attaching said first edge to said flat surface;

sweeping dust and debris across adhesively-attached first edge into said pocket and onto said opposite face of said sheet;

lifting said sheet off of said flat surface, and orienting said sheet with said closed end of said pocket facing said flat surface, while tapping said sheet to force said dust and debris to fall into the closed end formed by said joined edge;

pressing said adhesive coating along said third and fourth edges into contact with said opposite face of said sheet, thereby trapping said debris within the now sealed pocket formed within said sheet;

disposing of said trapped dust and debris along with said disposable sheet.

* * * * *